United States Patent [19]

Voss

[11] 4,081,767

[45] Mar. 28, 1978

[54] DOUBLE-STUB TRANSMISSION LINE ELEMENTS IN COMMUNICATION NETWORKS

[76] Inventor: William B. Voss, 387 N. Kenter Ave., Los Angeles, Calif. 90049

[21] Appl. No.: 777,395

[22] Filed: Mar. 14, 1977

Related U.S. Application Data

[63] Continuation-in-part of Ser. No. 639,008, Dec. 8, 1975, abandoned.

[51] Int. Cl.[2] ..... H01P 1/10; H01P 5/12

[52] U.S. Cl. ..... 333/7 R; 333/9; 333/97 R

[58] Field of Search ..... 333/6, 8, 9, 97 R, 7

[56] References Cited

U.S. PATENT DOCUMENTS

| | | | |
|---|---|---|---|
| 1,933,669 | 11/1933 | Gilman | 333/9 X |
| 2,579,751 | 12/1951 | Muchmore | 333/6 UX |

OTHER PUBLICATIONS

Ragan, *Microwave Transmission Circuits,* Rad. Lab. Series 9, McGraw-Hill, N. Y. 1948, pp. 517, 518 & title page cited.

*Primary Examiner*—Paul L. Gensler

[57] ABSTRACT

An element in a transmission line network consists of two short, open-ended stubs which are attached to a transmission line at a single station on that line and are of the same characteristic impedance as the line. The stubs act on a passing wavefront in the line to: first, reduce the forward voltage for the momentary duration of the two-way transit time within the stubs; then, to restore the forward voltage completely and without ringing. With the addition of high-input-impedance amplifiers, an improvement in communication branching is obtained and, with the addition of double-pole single-throw switches, an improvement in switching-tree performance is obtained.

7 Claims, 15 Drawing Figures

FIG. 1 PRIOR ART
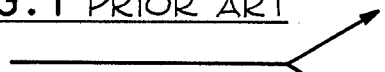
FIG. 2
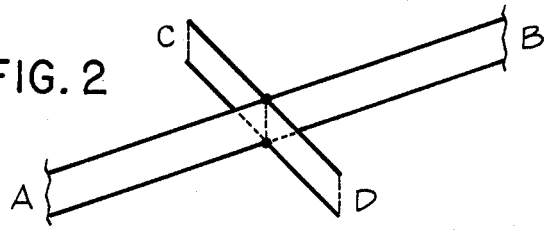
FIG. 3
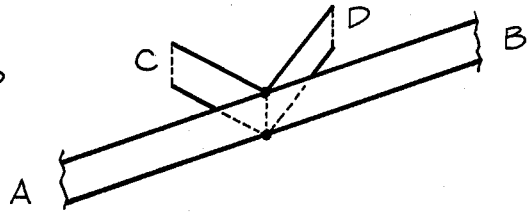
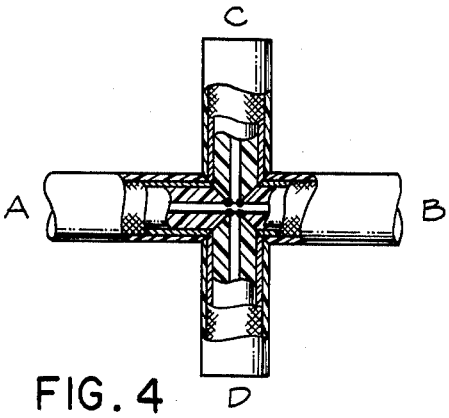
FIG. 4
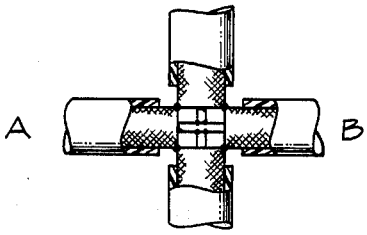
FIG. 5
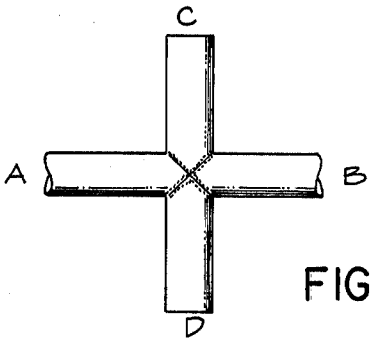
FIG. 6
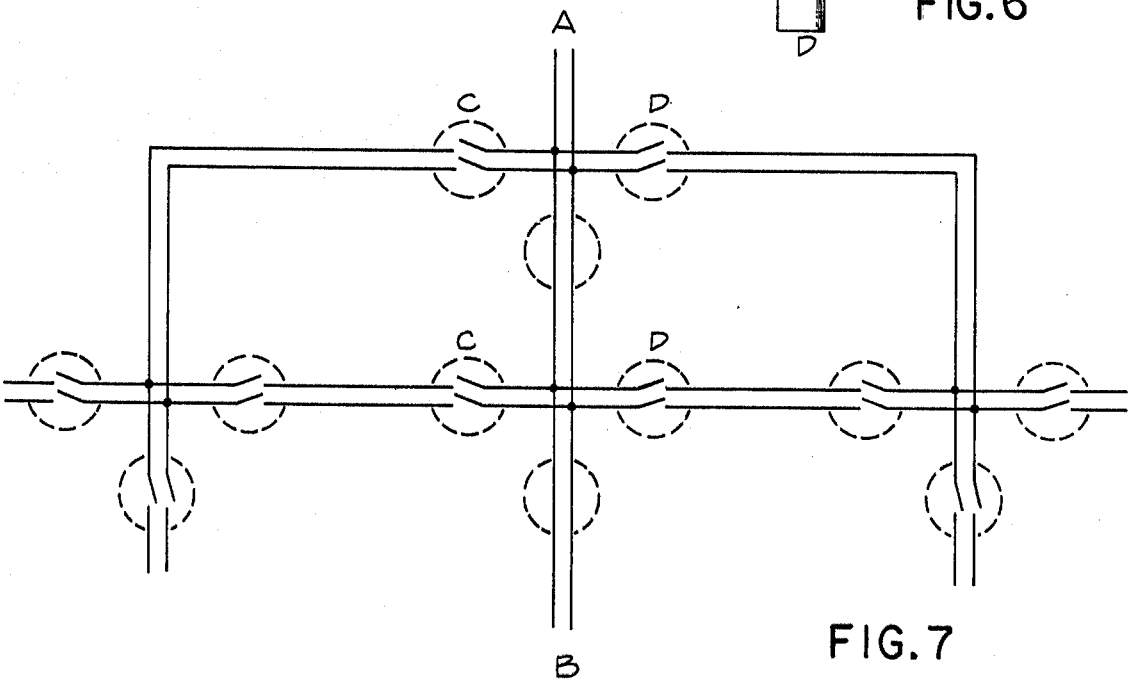
FIG. 7

DOUBLE-STUB TRANSMISSION LINE ELEMENTS IN COMMUNICATION NETWORKS

CROSS REFERENCE

This is a continuation-in-part of patent application Ser. No. 639,008, filed Dec. 8, 1975, now abandoned.

RELATED APPLICATION

Application Ser. No. 777,394, filed Mar. 14, 1977, titled "Single-Stub Transmission Line Elements for Communication Networks," is a companion application for a similar transmission line element which has an equivalent voltage restoration capability and provides a similar improvement in communication branching, but none in switching-tree performance.

BACKGROUND

In the prior art in communication networks of transmission lines a problem has always existed when branching of any sort was necessary. Essentially, all branching problems can be reduced to repetitions of the simple two-pronged branch represented by FIG. 1. Here, the stem and one of the prongs represent a main (or trunk) line, and the other prong represents a branch line to a wayside destination. Typical examples are: (1) a digital cable branching a few feet in distance from a computer-driven main cable to one of several peripherals stationed along the main cable, and (2) a main-line television cable with a branch line of several tens of feet in length leading to a customer's house. (Digital distributions systems of the type described in (1) are often called "party-line systems"). Such branching systems are basically troublesome. If the branch lines are terminated with the characteristic impedances of the cables, each such branch robs the trunk line of half of its power (or 29.3 percent of its voltage), and if the branch is terminated with any other impedance (or is left open-ended with an infinite impedance), the resulting transients ("ringing") caused by repeated reflections result in severe distortions of the signals carried by the cables.

In the U.S. Pat. No. 3,710,282 by Seinecke, issued Jan. 9, 1973, a considerable improvement ws made on the above problem in the case of branch line loads that are predominantly capacitative in nature. In Seinecke's invention, a resistor — equal to the "wave resistance" (characteristic impedance) of the branch line minus half of the wave resistance of the main transmission line — was inserted in series with the branch line adjacent to its junction with the main line.

In most of the prior art, the branching network is assumed to be carrying only CW (constant wave) signals consisting of a carrier wave with only small variations in wavelength due to modulation. In general, the lengths and placements of the branches are stated in terms of fractions or integral numbers of wavelengths of the contained signal insofar as they apply to lengths of the branch line or the placement of the branches with respect to the terminus of the main line. The branches may be open or may be terminated with a variety of impedances. The characteristic impedances of the branch lines are generally equal to that of the main line, but may rarely be higher. In effect, the branch lines in the typical case become stubs.

There is additionally a general practice of stubbing which has no intent of providing branch signal lines, but only of modifying the behavior of the signal of the main line. From one to three stubs may be involved, often open-ended, and the stub lengths and mainline placements are invariably stated in terms of fractions or integral numbers of the wavelength of the contained signal. In one case (U.S. Pat. No. 1,933,669), stubs are added to branches, but they are still stated in terms of the carrier signal wavelength. None of these cases is suitable for pulsed or broad-band signals without incurring excessive losses due to transients and signal distortions.

For pulsed signals, there may exist a rare usage of a pair of stubs of nearly, but not exactly, equal lengths for the purpose of performing some act of discrimination on closely-spaced pulses that are generated in the field of nuclear electronics.

In general for pulsed signals, Bewley lattices (which are "bounce diagrams" of time and distance parameters) show that reflections in random-length, single, open-ended stubs are repeated. They die exponentially, sometimes slowly. Each new round trip in the stub is a source of new perturbations on the incoming and outgoing main line. Similar troubles occur if the stubs are closed. Even if the stubs are terminated in characteristic impedances and are either short or long, becoming branch lines, the base junctions of the stubs are sources of unwanted reflections and serious loss of forward power in the main line.

The prior art in switching trees consists of two types. The first type is composed of two-pronged switching elements, providing a one-to-two series fan-out, or can be reversed to a two-to-one series fan-in. In multiple-outlet switching trees it contains $n$ stages in series for a maximum of $2^n$ possible outlets, of which one outlet is selected by choosing the appropriate switches through the tree to provide the desired path. This type of tree has two defects. First, it maximizes the number of switches and, consequently, the amount of contact resistance in the selected path. Second, it has $n$ single stubs along its path, each of which is a source of multiple reflection whose ringing severely distorts the signal in the path. Parasitic capacitance on the path is minimized, however. The second type of switching tree is hardly a tree at all, but is commonly called a "multiplexer." It has only one stage in which the inlet goes directly to the outlets in star fashion. The desired path is usually selected remotely. For, say, $2^n$ outlets in the multiplexer, the desired path has $2^n$ distortion-producing stubs, all at one junction. Although contact resistance is minimized, being only one contact, the $2^n$ stubs maximize parasitic capacitance. Thus a 32-branch tree has five levels of switching elements. The second type is a multiplex type of switch which has only one level of fan-out or fan-in going, say, from 1 to 32 or 32 to 1. In-between series are not used. While the first type minimizes the parasitic capacitance per path, it maximizes the series contact resistance. With the multiplex series it is the reverse. When either type of switching tree is used on transmission lines, however, a significant distortion is imposed on the signal (either pulsed or CW) which travels through the line. This distortion arises from the reflections at the branch points and the open stubs that inherently occur in the switching trees.

SUMMARY

When two short, equal-length, open-ended stubs are added to a transmission line at any selected station on that line and the stubs are of the same characteristic impedance as the line, a unique effect is obtained in which those portions of a wavefront (in the line) that enter the stubs and are reflected from the ends of the stubs interact at the junction at the base of the stubs to accomplish several desirable effects at the instant of interaction: (1) they completely cancel the remaining portion of the wavefront that was reflected rearward on the line from the junction, leaving only a short, small pulse as the rearward reflection, (2) they completely restore the forward portion of the wavefront from a momentarily attenuated voltage to the full voltage of the incoming wavefront, and (3) those portions of the wavefront that originally traversed the stubs are, through self-cancellation, prevented from entering the stubs again. The combined cancellation-restoration effect at the instant of interaction prevents any ringing or overshoot occurring on the signal in the line.

Through a multiplicity of these double-stub junctions, and the proximate attachment of high-input-impedance amplifiers to either one or both of the open ends of the stubs in each junction, in a manner that essentially preserves the open-circuit condition of the stubs, a method of branching from transmission lines is obtained which minimizes distortion and transients in the signals and greatly reduces voltage losses on the main line.

Also, in a transmission-line network comprising a one-to-many switching tree (in which one of many output lines may be selected), signal distortion and voltage losses are similarly minimized provided that the tree is constructed of elements of a one-to-three branching (fan-out) structure. Each such element comprises an input line (trunk) and three short, equal-length output lines (branches), with a double-pole, single-throw switch placed at the end of each branch. Each such switch leads to the trunk of the next element in the tree. Only those switches are closed which select one path through the tree, thereby forming a sequence of double-stub junctions.

BRIEF DESCRIPTION OF THE DRAWINGS

FIG. 1 is a diagrammatic, non-detailed illustration of the prior art in signal branching.

FIG. 2 shows the double-stub element in the balanced form of a cross, using twin-lead as the vehicle of the transmission line.

FIG. 3 shows the double-stub element in an unbalanced form, using twin-lead as the vehicle of the transmission line.

FIG. 4 is an elevational, top view of a double-stub element in balanced form using coaxial cable as the vehicle of transmission line. The junction region is cut away to a cross-sectional view.

FIG. 5 is an elevational top view of the junction region of a balanced, coaxial-cable, double-stub element in which the shields are joined simply at just four points.

FIG. 6 is an elevational, top view of the junction region of a balanced, coaxial-cable, double-stub element in tubular metal shields which have been joined together in crossed circumferential seams.

FIG. 7 shows a small switching tree containing four elements, each with the one-to-three branching concept; the center line has been selected at the path through the tree.

FIG. 9 represents the prior art with a single, open-ended stub and shows the ringing and overshoot which result from a pulse with a fast risetime. FIG. 10 is like FIG. 9 except that a second stub has been added to the first. FIG. 11 is like FIG. 10 except that a pulse with a slower rise-time was used. FIGS. 10 and 11 clearly show the elimination of ringing and overshoot which result from the addition of the second stub.

DETAILED DESCRIPTION

The Basic Concept

Figure 9:
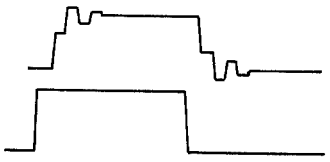
FIGS. 9, 10 and 11 are oscilloscope traces showing input pulses (low portions of each figure) and output pulses (upper portions of each figure) of certain combinations of stubs and pulse risetimes.

The usual practice when branching from a transmission line is to insert one open-ended stub into the ine. When two open-ended stubs are inserted in transmission line, as in the present invention, the perturbations, (in a traveling wavefront) that are caused by the two stubs will last only as long as the double-length transit time in the stubs. Following the one transit in the stubs, and the short time delay that results, the effect on the wavefront is as though the stubs were not there. The portions of the wavefront energy that enter the stubs and return to the junction after being reflected from the ends of the stubs seemingly cancel each other at that junction. Actually, those stub-traveling portions of the wavefront combine with the main-line portions to produce three desirable results: (1) to completely cancel that portion of the wavefront energy that was reflected backward from the junction on the main line when the wavefront first reached the junction; (2) to completely restore to full voltage and power the forward-going portion of the wavefront, which portion was attenuated during the two-way transit time of the wavefront in the stubs; and (3) to prevent, through self-cancellation, any of the stub-traveling portions being reflected back into the stubs from the junction. This new arrangement eliminates the "ringing" and overshoot that normally appear in the main-line and stub signals when common single stubs are used (by prior art). Such ringing and overshoot are caused by the exponentially decaying, repeated reflections that are inherent in ordinary single stubs when pulsed signals are present in the lines. A simple example is shown in FIG. 9. In this discussion, it is assumed that the double stubs are of the same characteristic impedance as the main line, are of equal lengths, are open-ended (i.e., the ends have essentially infinite impedance between the conductors) and, finally, are relatively short in length. The shortness will be defined in the next subsection.

Structural Form

In structural form, the invention is extremely simple. Its basic element is merely the attachment of two short, open-ended stubs of exactly equal lengths to a transmission line at a single station on that line. The stubs are of the same characteristic impedance as the main line to which they are attached. (The comparable case of a single stub, which is at exactly half the impedance of the main line, is submitted in the companion application, Ser. No. 777,394, filed Mar. 14, 1977.)

The transmission lines and stubs may be of any form of line in which the wavelength of the highest frequency component of interest in its signals is large compared to the diameter or width of the line. Permitted forms of transmission lines are: coaxial cable, twin-lead, microstrip, and stripline. Waveguides are excluded because of the shortness of signal wavelengths. The exact length of the stubs, aside from being "short," is not critical because the cancellation-restoration effect on the reflections is entirely independent of the wavelength of the contained signals. This is in contrast to the usual stub in the prior art which must be at one-quarter or some other fraction of a referent wavelength in order to be effective. For this invention, the shorter the stub, the less will be its effect on the shape of the wavefront in the main line.

For pulsed signals with linearly increasing wavefronts, such as a straight pulse rise, the best results occur when the two-way transit time of the signal in the stub is no greater than the risetime from 0 percent to 100 percent of pulse voltage. The same relationship applies between linearly decreasing wavefronts (straight pulse falls) and the pulse falltime from 100 percent to 0 percent of pulse voltage. The equivalent stub length is 50 percent of the pulse rise. With longer stubs, a small step begins to appear at the 50 percent voltage level in the pulse rise, likewise in the pulse fall. For some uses, such as certain types of digital logic, such a horizontal step is not harmful, and stubs of up to twice that length can be tolerated.

For best results in CW signals the two-way transit time in the stubs should be no greater than the time of the zero-to-peak voltage rise of the highest frequency component of interest in the signals in the line. Such a time corresponds to one-quarter wavelength of a cosine wave. The equivalent one-way length of the stubs is one-eighth of the wavelength of the highest frequency component of interest for CW signals. This is the maximum stub length for single elements on a line with CW signals. When the number of stub pairs on a line increases above one, allowable stub lengths must be reduced, as calculations will show later in "Electrical Characteristics, Part 2."

The method of connection between the stubs and the main line is not critical to the concept of the invention but a high quality of workmanship in a junction provides a much cleaner waveform than a poorly constructed junction. FIGS. 2 through 6 illustrate some various attachment methods. FIG. 2 shows a balanced method of attachment for twin-lead in which the stubs are on opposite sides, forming a cross. The main line extends between A and B. Ends of the stubs are shown as C and D. Neither stub needs to be at right angles to the main line; in fact both stubs can be on one side of the line, as shown in FIG. 3. In FIG. 3 an unbalanced method of attachment is shown, and the letters A, B, C and D represent the same parts as in FIG. 2. It is noted that the line AB may be bent at the junction. In FIG. 4 is shown a balanced double-stub element in coaxial cable form. The junction area is cut away to a cross-sectional view in order to show the attachment of the center conductors. The functions of the letters A, B, C and D are as in FIGS. 2 and 3. FIG. 5 illustrates a simple but crude method of attachment of the shields for the type of structure in FIG. 4. It is an elevational top view of the junction region at the center of an element. The shields are joined only at the four corners shown, leaving a square section in the center of the junction in which the shielding and much of the insulation may be omitted. FIG. 6 illustrates a better method of attachment for the shields. It is an elevational top view of the preferred form of a double-stub element, and it shows how the seams are joined by soldering or welding at sections of circumferential ellipses which are crossed at 90 degrees to each other. The shields shown in FIG. 6 are of tubular metal instead of braid, although the latter could be used in larger cables, with difficulty. Although FIG. 6 has no plastic external covering, such a covering could be added if desired. Actually, FIG. 6 is intended to be sufficiently general that it can represent either soft junctions solely of cable or hard junctions of separate pieces of hardware that are inserted into the main line by means of coaxial connectors, one on each side of the element. FIG. 5 junctions are suitable only for lower frequencies in the RF range. FIG. 6 junctions are for all frequencies.

In the "hard junction" interpretation of FIG. 6 the double-stub element is a prefabricated hardware device in the form of a Greek cross. An RF connector of low VSWR (one-half of a mating pair of connectors) is provided at each mainline end, A and B, and the cross-line forms the stub of the device.

In coaxial cables, the junctions may be unbalanced as well as balanced, although it is desirable that the four arms be oriented at 90° angles to each other. Thus, in FIG. 4 it is possible to have main-line arm B alternate places with either stub arm, C or D. In such an unbalanced structure, the main-line is bent at 90°. Other structural forms, balanced and unbalanced, are possible but are not recommended.

In some stringent applications, radiation-reducing modifications may be needed for the open ends of the stubs. Such modifications are described later in the specification.

An amplifier may be placed at the end of either stub (or both stubs) in order to relay the signal appearing at the end of the stub to some desired receptor (receiving station) off the line. The amplifier(s) must be of high input impedance, preferably more than 1,000 times the characteristic impedance of the line. Two other restrictions on such an amplifier are essential: first, the geometry of its input circuit must not compromise the above restrictions on impedance or stub length; and second, the frequency response of the amplifier must be adequate for the signal. Common microcircuit or hybrid amplifiers with very fine, short input leads are most suitable for this purpose. To minimize the distortion to the stub that such an attachment of an amplifier can cause (because its input leads become an unwanted extension of the conductors of the stub and introduce a finite impedance at the end of the stub), one or two isolation resistors of at least 10,000 ohms resistance each should be inserted between the stub conductors and the input leads to the amplifier.

More than one of the double-stub elements may be placed in series on a line. As long as the quality of the stubbing is good there is no inherent limit on the number of such elements in series, but practical limits will be imposed where preservation of signal fidelity is important. The spacing between elements is unimportant for pulsed signals, but it is of some importance for CW signals. The latter case is discussed later in the specification.

Since the use of these elements in lines is of value only if some branching of the signal is intended at the elements, such as in switching circuits, the lines with these elements can, and should, be classed as networks. This specification, then, inherently includes the networks which include these elements as an integral part.

The first type of network to be considered is the switching tree consisting of 1-to-3 type elements as illustrated in FIG. 7. The diagram shows 9 outlets of a 27-outlet tree. The coils of the switching relays, and their circuitry, have been omitted for clarity of illustration. Note that the selected path (any one of 9 could have been selected) consists of two double-stub elements in series. (It was this network in which the unique characteristics of the invention were first discovered.) The "selected path" in FIG. 7 is the central branch, in which all switches are shown closed. The 1-to-3 switching tree, which inherently contains the double-stub elements, retains the common advantages of the stubs in reduction of distortion and losses in the forward-going signal, plus reduction of losses due to rearward reflections. In addition, it furnishes the best practical compromise ("tradeoff") between minimums of contact resistance and parasitic capacitance on any path selected through the tree.

The second type of network for which these elements are considered is any type of transmission line with regular (unswitched) branches occurring at various places along the line. The branches may be either single or double. Such branching is accomplished using these elements aided by the amplifiers described earlier. This second type of network has limitless forms. Some of these are:

1. Multiple-station digital buses ("party-line" buses) which are used between control computers and test equipment in automatic test systems;
2. Community television cable systems for distribution to homes; and
3. Microstrip systems on printed circuit boards. This list is not intended to be complete.

The electrical characteristic of the double-stub elements are a little more involved than the structure. These characteristics will be presented in two parts, the first part treating digital (pulsed) signals and the second part treating CW signals. (This follows the order of discovery.) An additional third part treats a problem of radiation from the stub ends.

A requirement for networks using the double-stub concept is that the source impedance of the line driver must match the characteristic impedance of the line, otherwise the reflections generated however small, will not be absorbed.

ELECTRICAL CHARACTERISTICS

Part 1 — Pulsed Signals

Figure 8:
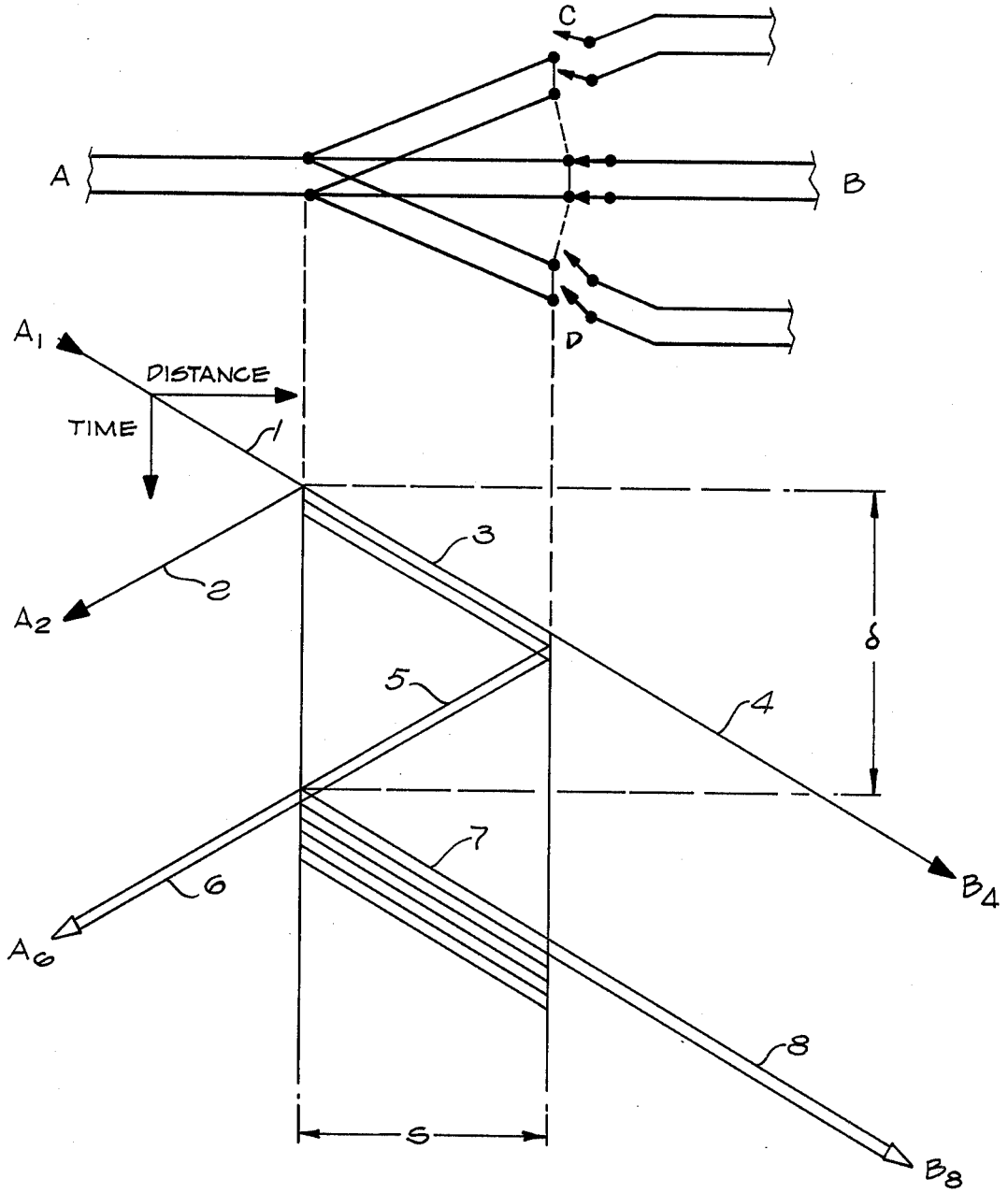
FIG. 8 shows one balanced, double-stub element in a switching tree and relates it to a variation of a Bewley lattice to aid in describing the actions of various wavefronts in the element.

Consider FIG. 8, in which the first double-stub element of the switching tree of FIG. 7 is shown at the top in a slightly different form. Below it is shown a modified form of the Bewley lattice. The position of the signal on the line (going from left to right) is shown horizontally, and the corresponding time is shown vertically. The signals in the stubs, which would logically belong in the third dimension, normal to the paper, are shown adjacent to those in the main line. The reflection point corresponding to the junction and the stub ends are obvious. A little care is necessary to distinguish the main signals from the adjacent (lower) stub signals. (More explanation is given in the next paragraph.) Further, let S be the length of each stub and $\delta$ the time required for signal travel out and back in the stubs. Then $$\delta = 2S/v$$

where $v$ is the signal velocity.

Let a signal of voltage and current amplitudes of V and I, respectively, enter the stub junction. This is shown in the Bewley lattice as A1 and line 1. There is an immediate reflection of part of the signal back to origin (A2) of $-\frac{1}{2}V$ and $+\frac{1}{2}I$, representing $\frac{1}{4}$ of the signal power and being shown by line 2. Each of the three lines under 3 in the lattice represents $\frac{1}{4}$ of the signal power. The top line has amplitudes of $\frac{1}{2}V$ and $\frac{1}{2}I$ and leads uninterruptedly through line 4 to the outlet at B4. The lower two lines under 3 in the lattice represent the signals in the two stubs. Each of these amplitudes is also $\frac{1}{2}V$ and $\frac{1}{2}I$. These two signals are reflected from the stub ends as shown under 5 in the lattice. These amplitures are $\frac{1}{2}V$ and $-\frac{1}{2}I$ for each. Each of these signals branches four ways at the junction as shown by the lines under 6 and 7. Each line in 6, going to the origin in A6, has amplitudes $\frac{1}{4}V$ and $-\frac{1}{4}I$. The top two lines under 7 each have amplitudes $\frac{1}{4}V$ and $\frac{1}{4}I$. These signals continue under 8 to outlet B8. Of the bottom four lines under 7, two have amplitudes $-\frac{1}{4}V$ and $-\frac{1}{4}I$ and two have amplitudes $\frac{1}{4}V$ and $\frac{1}{4}I$, causing self-cancellation. Notice that, except for a small time difference $\delta$, the signals in 2 and 6 cancel each other. Likewise, the signals in 4 and 8 combine to equal the full incoming signal of V and I except for a time delay of $\delta$. In real systems $\delta$ is measured in picoseconds.

Figure 10:
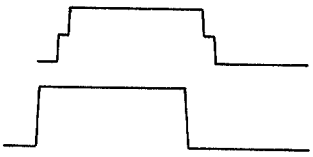
Figure 11:
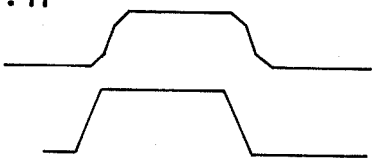

In a special laboratory test of the double-stub transmission line element using coaxial lines, some oscilloscopic traces of 500-nanosecond pulses were obtained. FIGS. 9, 10, and 11 show hand tracings of the photographic results. In each figure the upper pulse was measured after passing through a stub junction (to be described), and the lower pulse is an equivalent input pulse. The upper pulses traversed 30 feet of mainline, RG58 C/U cable, and the lower pulses traversed 3 feet of the cable. (A dual output generator was driving.) In FIG. 9 a single open-circuited stub of 10-foot length was used, and the response shows the typical ringing of that configuration. In FIGS. 9 and 10 the input risetimes and falltimes were less than 3 nanoseconds each. In FIG. 10 two 10-foot, open-circuited stubs were used, joined as in FIGS. 4 and 5 but with an even poorer quality of junction. The steps in the upper trace at the 50 percent amplitudes are due to the propagation delays (of 32 nanoseconds) in the stubs. The effect of the stubs on pulses with slower risetimes and falltimes is shown in FIG. 11. In these tests, lengthy stubs were used in order to accentuate the delays. In practice, the stubs would be from fractions of an inch to a few inches at most. Both source and load impedances were 50 ohms each in the tests. Characteristic source and load impedances should be employed similarly in practice.

The question arises about the effects of more than two equal-length stubs attached in parallel at one point on a transmission line. The calculations of the effects of multiple stubs is difficult, entailing either (1) great tedium and care, or (2) new approaches to tensor or group theory. In the laboratory test, the writer tried 1, 2, 3, and 4 stubs. Only the two stubs showed the desired cancellation of the ringing. Approximate calculations indicate that no other combination than two has the internal cancellation effect and that the more stubs one places in parallel at one location, the less amenable they are to transmission line treatment and the more they must be considered as an aggregate, lumped capacitance.

The question also arises about the effects of placing the hereindefined double stubs at more than one location, say $n$ locations, in series on a transmission line. For example, the 1-to-27 switching tree cited earlier contains three such locations in series, no matter which of 27 paths is selected. The total effect is simply additive; i.e., the total increase in line delay, D, due to all of the stubs is equal to the sum of the individual delays, $\delta$, caused by each pair of stubs. The effect on the final shapes of the pulse rises and the pulse fall is a little complicated. In steep-sided pulses, the number of steps required to reach full amplitude (or reverse) is $2^n$. In ramp-sided pulses (with slow rise and fall times), the effect is to cause more rounding of the sharp corners (but still less than D in the total effect). Since it is the object of the designer who uses the double-stub concept to keep the individual stubs short, the total delay caused by $n$ locations (2n stubs) will be kept small, and is equal to $$n\delta = 2nS/v$$

Even with $n$ locations however, there is no ringing.

In this specification the term "pulsed signals" is intended to include most digital signals of two or three voltage levels of DC. Exempted signals are those of modulated carriers, such as FSK.

ELECTRICAL CHARACTERISTICS

Part 2 — CW Signals

The use of double-stubbing on CW signals in the form of pure sine waves has both favorable and unfavorable effects. For the forward-going portion of the wave — beyond the stud intersection — the effect is favorable. There is no distortion; the amplitude reduction is slight; the phase delay is small and is generally harmless. For the reflected portion of the wave the effect could be serious if more than one double-stub junction should be placed on the line (or if the signal generator were unmatched). The seriousness is due partly to the fact that the CW reflected wave is continuous rather than being of short, transient duration, as is the nature of reflected pulsed waves. Even though the CW reflected wave's amplitude is small, it cannot be neglected completely if it is ever rereflected forward again at a second junction. That is due to the amplitude-sensitive nature of CW (analog) signals in general.

In contrast, pulsed (digital) signals are quite insensitive to amplitude variations, requiring only that the signals be above or below their triggering voltage level. The rereflected pulsed wave is always 25 percent or less of the normal wave and thus is below the voltage level of triggering (Severe noise could cause some problems, however.)

For the reason of rereflection cited above, the maximum stub length allowable for use with CW signals, when a second function is added on a line, is about 5 percent of the signal wavelength. For the general case of three or more double-stub junctions on a line the stub lengths should be considerably less, partly to render rereflected waves harmless and partly because of amplitude degradation in the forward-going waves. The latter condition is due to phase delay effects, which will be shown in the discussions on $Y_n$ and $S_n$ in subsequent paragraphs.

When modulation is added to sine waves the effect is more complicated and it is treated briefly later.

Figure 12:
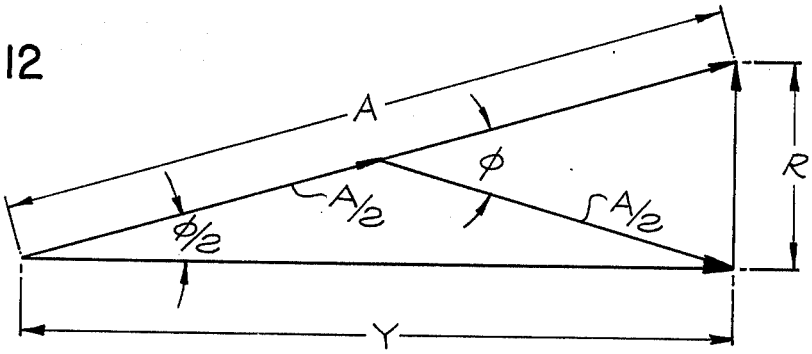
FIG. 12 shows a rotating vector diagram for explaining the action of CW signals in a double-stub element.

Consider again one stub pair as in FIGS. 2 or 3. Assume that the stub lengths, S, are small compared to the wavelength, $\lambda$, of the signal (say, less than 5 percent of $\lambda$). Then if one ignores the skin effect and the cable losses inherent in transmission lines the attenuation caused by the stub pairs is small and there is no distortion. The reflected signal is fairly small. If we call the input voltage amplitude A, the output consists of two components of equal amplitudes, A/2. A time delay, $\delta$, equivalent to a phase delay, $\phi$, separates the two output components. This is shown graphically by a rotating vector diagram in FIG. 12. Y is the resultant output signal amplitude (being the vector sum of the initial and delayed components, A/2 each). The net phase delay between input A and output Y is $\phi/2$ radians. The reflected component is shown by R, where $$R = A \sin \phi/2.$$

Some further statements are:

$$\delta = 2\,S/v \text{ (as before)}$$

$$\phi = \omega\delta = 2\pi f\delta = 2\pi v\delta/\lambda \text{ radians}$$

$$\phi = 4\pi\,S/\lambda \text{ radians.}$$

where $\omega$ and $f$ are angular velocity and frequency, respectively. If we let $S/\lambda = 0.05$, which is the 5 percent assumed above, $$R = 0.31A.$$

Call $R_2$ the reflected amplitude from a second double-stub junction. Then $$R_2 = (0.31)^2 A = 0.096A.$$

In order to reduce $R_2$ to 1 percent of A, $S/\lambda$ should be no greater than 0.016.

The expression for output amplitude of the forward-going wave of a CW signal is given by $$Y_1 = \frac{A}{2}\,e^{-j\omega t} + \frac{A}{2}\,e^{-j\omega(t-\delta)}$$

$$Y_1 = \frac{A}{2}\,e^{-j\omega t}(1 + e^{j\omega\delta})$$

The subscript 1 is introduced to represent one stub pair place on a line.

For the case of two stub pairs in sequence along a transmission line:

$$Y_2 = \frac{A}{4}\,e^{-j\omega t}(1 + 2e^{j\omega\delta} + e^{j\omega 2\delta})$$

$$Y_2 = \frac{A}{4}\,e^{-j\omega t}(1 + e^{j\omega\delta})^2$$

For $n$ stub pairs in sequence we have $$Y_n = \frac{A}{2^n}\,e^{-j\omega t}(1 + e^{j\omega\delta})^n$$

which might be written $$Y_n = Ae^{-j\omega t}\left(\frac{1+e^{j\phi}}{2}\right)^n$$

The parenthetical portion defines the number and respective amplitudes of the various output components very simply by means of the binomial theorem.

It is essential to know what maximum stub length, $S_n$, can be tolerated when $n$ stub pairs are in sequence, assuming a certain allowable degree of attenuation of the final signal. The calculation becomes fairly easy if we assume an allowable attenuation of 50 percent of input power, corresponding to an output/input voltage ratio of $1\sqrt{2}$. (Transmission losses are neglected.) For this, $\phi$ is determined by $$\cos \phi/2 = \sqrt[2n]{0.5}$$

from which $S_n$ is given by $$S_n = \lambda\phi/4\pi$$

Thus, if one assumes a television cable feeding $n$ customers in sequence, with a stub pair for each customer, then the allowable stub lengths are $$S_{10} = 0.042\lambda \text{ (where } n = 10)$$

$$S_{99} = 0.013\lambda \text{ (where } n = 99)$$

When the effect of line loss is considered, the allowable stub lengths become larger but the calculations involved become extremely tedious.

When the input waveform is modulated (by amplitude, frequency, or phase) a small amount of distortion is introduced into the resultant output waveform by the stub pairs along the line. As long as the stub lengths are small and the spectral deviations due to modulations are small, this distortion is negligible for communication purposes.

An alternative approach where many stub-pair installations are desired, and the network has one basic carrier frequency, is to make the stubs of lengths $\frac{1}{2}\lambda$, where $\lambda$ is now the carrier wavelength. If the reflected wave magnitudes are small the spacing between stub pairs on a line is immaterial. If the reflected waves cannot be neglected, due to inability to keep the stub lengths small enough, their ghosting effect can be minimized by separating adjacent stub pairs by an approximate distance $(K + \frac{1}{2})\lambda$ on the line, where K is an integer and $\lambda$ is the principal or average wavelength of interest, such as the carrier wavelength. This promotes a self-cancellation of reflected waves between pairs. The distance $(K + \frac{1}{2})\lambda$ is not a general limitation on the placement of multiple stub pairs on the line. It provides no advantage either when S, the stub length, is small enough to render the reflected waves insignificant of when the signals are pulsed instead of CW.

ELECTRICAL CHARACTERISTICS, Part 3

When the diameters or the widths of the transmission lines are an appreciable fraction of the shortest wavelength of interest in the signal, say over 1 percent, or when many of the stub pairs are to be installed on a line, say more than 10, the problem of radiation of energy from the open ends of the stubs must be addressed. In either or both of these cases, the losses due to radiation can be reduced by special treatment of the open ends of the stubs. Two methods of treatment are proposed here, both of which involve the modification of the stubs to reduce their cross-sectional dimensions at the ends to a fraction of the unmodified dimensions. The descriptions given here of the methods are for coaxial hardware of the type shown in FIG. 6, however the principles used are obviously adaptable to either twin-lead or microstrip lines.

Figure 13:
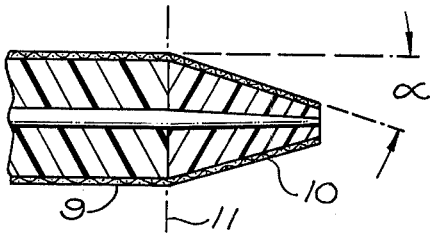
FIGS. 13 and 14 represent, in longitudinal cross-sectional views, two methods for modifying the ends of the stubs in order to reduce radiation losses from the stub ends.

Method 1 is shown in longitudinal cross-section in FIG. 13. Item 9 is the unmodified portion of the stub and its dimensions are those of the main line adjacent to the junction. Item 10 is the modified portion with a reducing angle $\alpha$, where $$\alpha = 22.5° \pm 7.5°$$

The tolerance of 7.5° allows the stubs to be adapted to different networks. It is not an allowable tolerance within the stubs in one network. Both the center conductor and the inner wall of the shields are sections of cones such that the characteristic impedance of the lines is preserved. This preservation is obtained by maintaining a constant ratio between the diameters of the inner conductor and the interior surface of the outer conductor. The cone is truncated at a station such that the diameters cited above are reduced to a fraction, $\beta$, of their original base values. The value of $\beta$ is $$\beta = 0.375 \pm 0.125$$

where the tolerance of $\pm$ 0.125 allows the stubs to be adapted to different networks, as above, and to different needs of radiation reduction. Since, for a given form of signal, the radiation is reduced by the fourth power of $\beta$, total reduction is significant. For the nominal $\beta$ value of 0.375 the total reduction is by a factor of over 50.

Item 11 shows the interface between the unmodified and the modified portions. It is the station that defines the base of the cones. The center conductor is continuous across the interface, merely changing from cylindrical to conical form. The dielectric which fills the spaces between the inner and outer conductors may be discontinuous across the interface for ease of fabrication. The outer conductor is discontinuous before fabrication but it must become continuous across the interface after fabrication.

Figure 14:
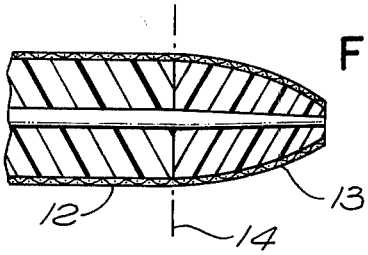
Figure 15:
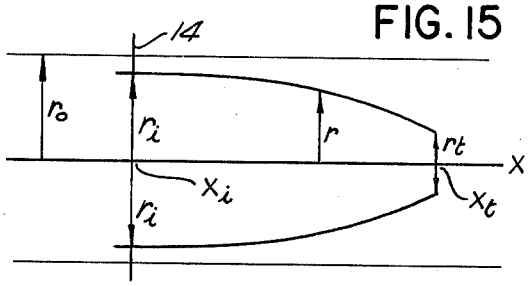
FIG. 15 supports the mathematical formula for the method in FIG. 14.

Method 2 is shown similarly in FIG. 14. The only difference between Methods 1 and 2 is that the conical reduction scheme of Method 1 is changed to curves of rotation in Method 2. These curves are exponential curves given by the formula $$r_o - r = (r_o - r_i)e^{m(x-x_i)},$$

which is illustrated in FIG. 15. The subscript $i$ represents the plane of the interface, which is Item 14 of FIG. 14, and the subscript $t$ represents the plane of truncation, or stub opening. $x$ represents position along the longitudinal axis of the stub. $r$ is the radical distance from the longitudinal axis of the stub to the inner surface of the outer conductor (shield). $\beta$ is given by the ratio of $r_t/r_i$ and has the same value as in Method 1: $0.375 \pm 0.125$. $r_o$ is the radial distance from the longitudinal axis of the stub to the asymptote of the exponential curve. $m$ is the length/radius ratio and is given by $$m = (X_t - X_i)/r_i$$

The center conductor of Method 2 (which is omitted in FIG. 15 for clarity) has a similar exponential curve of rotation but with a much larger value of *m*, as required to maintain a constant characteristic impedance.

There is nothing to prevent the modification methods described in Methods 1 and 2 from being almost complete substitutes for the stubs as they have been described heretofore. In such a substitution the interface planes, Items 11 and 14 of FIGS. 13 and 14, are moved inward toward the main line until they are just contiguous (and tangent) to the outer surface of the outer conductor of the main line. In essence, the modified stubs of either method replace the regular stubs of FIG. 6.

ADVANTAGES

The primary advantage of the double-stub invention is that, when used with amplifiers as described in this specification, it enables a pulsed or CW electrical signal on a transmission line to travel past a branching point on that line with a minimum of distortion and energy loss in the forward direction on the line and a minimum of energy reflected backward from the junction. The reduction in distortion is obtained by the elimination of repeated reflections within the stubs, which thereby eliminates overshoot and ringing. The secondary advantage of the invention is that, when used in one-to-three switching trees, with double-pole single-throw switches defining the stubs as described in the specification, it similarly provides for the selected path through the tree the same minimization of distortion and losses in the forward direction and minimization of reflected energy in the rearward direction. Further, it provides for the selected path through the tree a practical compromise for achieving the lowest values of both contact resistance and parasitic capacitance.

In the light of the above teachings of the preferred embodiment disclosed, various modifications and variations of the present invention are contemplated and will be apparent to those skilled in the art without departing from the spirit and scope of the invention.

What is claimed is:

1. A high-frequency electrical signal transmission-line network comprising multiple double-stub elements connected on a main transmission line, each said element containing two short stubs, both being open at their distant ends, being of exactly equal lengths, being of the same characteristic impedance as the main line, and attached structurally and electrically at a single station on the main line in such a manner that at the resulting stub junction each of the two stubs and the single outgoing portion of the same main line present an equal impedance, in parallel form, to the incoming portion of said main line;

the spacing between said double-stub elements being unrestricted for lines carrying pulsed signals, being unrestricted also for lines which carry CW signals and in which the said stubs are sufficiently short to avoid rereflection of signal waves, but, on the other hand, said spacing being restricted to a distance of $(K+\frac{1}{2})\lambda$ for all remaining lines carrying CW signals, $\lambda$ being the carrier signal wavelength and K being any integer;

said double-stud elements substantially eliminating ringing and overshoot and substantially reducing remaining distortion and forward-going power losses in pulsed wavefronts traveling in stubbed transmission lines.

2. A transmission-line network as described in claim 1 wherein said transmission line is a coaxial cable, the manner of attachment of said double stubs to the said main line in each said element of claim 1 comprising a junction region substantially in the form of a square, said square being located in the junction region and being approximately coplanar with the main line and stubs, and at the four corners of said square.

3. An extension of the network in claim 1 wherein is provided a branching capability from the signal in the same main line of said network to multiple branch receiving stations, the said branching capability being provided by structurally and electrically attaching a small amplifier to the open end of each of the stubs of each double-stub element of claim 1;

the input impedance of which amplifier is high, exceeding the characteristic impedance of the stubs by at least 1,000 times, and the input geometry of which amplifier does not compromise the impedance of length of its corresponding stub, such that the internal reflection of the said pulsed wavefront within the connected said stub is complete and undisturbed by the presence of the amplifier, which said amplifier is able to sense and relay the pulsed wavefront within the stub to the said branch receiving station in undistorted form.

4. An extension of the network in claim 1 wherein is provided a switching tree from the incoming main line by utilizing the double-stub elements as the basis for a one-to-three sequential branching system, the switching capability of which tree is provided by connecting double-pole, single-throw switches to the said elements, three switches to an element, in such a manner that:

(1) each of the free ends of the two stubs of an elements has a switch connected, each pole to a conductor, and the remaining single, outgoing line has the third switch connected, said third switch being inserted, each pole to a conductor, at such a distance from the junction in the element that the said outgoing line is transformed into a third stub of exactly the same length as the other two stubs;

(2) each of the said three switches in turn forms the beginning of the input line of a new element, such elements being repeated in a one-to-three multiplicative, fan-out sequence, where, through multiple stages of switching, up to $3^n$ output lines are provided, to a resolution of three lines, the exponent *n* being any chosen number of stages of switching; and (3) one, and only one, continuous path is selected through the tree from input to output, the path being selected by the closing of just one switch in each of the said stages of switching present in the said path through the tree, the purpose of said switching tree being the elimination of ringing and overshoot and the reduction of remaining distortion and forward-going power losses in pulsed wavefronts traveling through the tree, and a net minimization of parasitic capacitance and contact resistance in the selected path.

5. A coaxial, double-stub device which may be inserted in a main-line coaxial cable for the purpose of branching therefrom, said insertion being in multiple, selected locations along the main line and one said device to an insertion;

the spacing between said double-stub devices being unrestricted for lines carrying pulsed signals, being unrestricted also for lines carrying CW signals in which lines the said stubs are sufficiently short to avoid reflection of signal waves, but, on the other hand, said spacing being restricted to a distance of $(K+\frac{1}{2})\lambda$ for all remaining lines carrying CW signals, $\lambda$ being the carrier wavelength and K being any integer;

connection to the main-line cable being by standard coaxial connectors of low VSWR;

said device being a hardware element in the form of a cross, the main line of which cross is the trunk-line and is terminated at each end with one of said connectors, the cross line of which cross is open at both distant ends, forming two short, open-ended stubs of exactly equal lengths;

the exterior surface of said device being a tubular solid field, forming the outer, coaxial conductor of both the said trunkline and the stubs and being of a common diameter throughout, the junction between the stubs and trunk-line consisting of two elliptical seams oriented in planes 90° apart and 45° from both the trunkline and stub axes;

the inner conductor of which device forms a simple, one-junction cross located coaxially within the said outer conductor, the space between both conductors containing sufficient dielectric material for structural support;

the characteristic impedance of said device being uniform through and matching that of the connected said main-line coaxial cable;

said double-stub device substantially eliminating ringing and overshoot and substantially reducing remaining distortion and forward-going power losses in pulsed wavefronts traveling in a transmission line network which contains one or more said devices;

the stub ends of said device allowing small amplifiers to be structurally and electrically attached, one to each end, such that the internal reflections of a pulsed wavefront within the stubs are complete and undisturbed by the presence of the amplifiers, said amplifiers having an input impedance exceeding the characteristic impedance of the stubs by at least 1,000 times and being able to sense and relay the signal within the device to a branch receiving station in undistorted form.

6. An extension of the device in claim 5 wherein radiation from the stub ends is reduced by modifying the shape of the stub ends into truncated cones, small ends open, in which each of the modified cones comprises:

(1 ) an outer conductor of truncated conical shape, narrowing from the diameter of the stub outer conductor (at the cone's base) to an end diameter ratio of 0.375 ± 0.125, and with a semi-angle of narrowing which is 22.5 ± 7.5°;

(2) an inner, solid conductor of truncated conical shape narrowing from the diameter of the stub inner conductor (at the cone's base) to an end diameter ratio of 0.375 ± 0.125, such that the characteristic impedance of the parent stub is maintained unchanged; and (3) the space between said two conductors being filled with the same dielectric material as in the said stub ends before the said modification;

the narrow, open ends of said modified stubs being capable of structurally and electrically accepting amplifiers of the same type and in the same manner as in claim 5.

7. An extension of the device in claim 5 wherein radiation from the stub ends is reduced by modifying the shape of the stub ends by reducing the diameter gradually to smaller end openings, in which each of the modified ends comprises:

(1) an outer conductor whose shape is the curve of rotation of an exponential formula and which narrows the diameter of the outer conductor of the stub to an end diameter ratio of 0.375 ± 0.125;

(2) an inner, solid conductor whose diameter is a correspondently reduced curve of rotation of an exponential formula narrowing from the diameter of the stub inner conductor to an end diameter ratio of 0.375 ± 0.125, such that the characteristic impedance of the parent stub is maintained unchanged; and (3) the space between said two conductors being filled with the same dielectric material as in the said stub ends before the said modification;

the narrow, open ends of said modified stubs being capable of structurally and electrically accepting amplifiers of the same type and in the same manner as in claim 5.

* * * * *

UNITED STATES PATENT AND TRADEMARK OFFICE

CERTIFICATE OF CORRECTION

PATENT NO. : 4,081,767

DATED : March 28, 1978

INVENTOR(S) : William B. Voss

It is certified that error appears in the above-identified patent and that said Letters Patent are hereby corrected as shown below:

Column 1, line 43, correct the spelling of "was "

Column 4, line 23, correct the spelling of "line."

Column 7, line 51, add a comma after "generated";

Column 7, line 64, make "point" plural.

Column 11, line 56, delete "of" and substitute --or--;

Column 12, line 53, in the exponential "$e^{m(x-x_i)}$ reduce the size of the closing parenthesis and relocate it upward so that it remains part of the exponent.

UNITED STATES PATENT AND TRADEMARK OFFICE

CERTIFICATE OF CORRECTION

PATENT NO. : 4,081,767

DATED : March 28, 1978

INVENTOR(S) : William B. Voss

It is certified that error appears in the above-identified patent and that said Letters Patent are hereby corrected as shown below:

Column 12, line 59, delete "radical" and substitute --radial--;

Column 13, Claim 1, line 64, delete "stud" and substitute --stub--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*